US005757405A

United States Patent [19]

Bainvel et al.

[11] Patent Number: 5,757,405

[45] Date of Patent: May 26, 1998

[54] INK FEED SYSTEM FOR A POSTAGE METER

[75] Inventors: Jean-Marc Bainvel, Boulogne Billancourt; Jean-Pierre Gregoire, Brie Comte Robert, both of France

[73] Assignee: Neopost Industrie, Bagneux, France

[21] Appl. No.: 594,090

[22] Filed: Jan. 30, 1996

[30] Foreign Application Priority Data

Jan. 31, 1995 [FR] France ..... 95 01109

[51] Int. Cl.[6] ..... B41J 2/175

[52] U.S. Cl. ..... 347/85; 347/30

[58] Field of Search ..... 347/85, 86, 30

[56] References Cited

U.S. PATENT DOCUMENTS

| | | | |
|---|---|---|---|
| 4,440,083 | 4/1984 | Hooper . | |
| 4,628,332 | 12/1986 | Matsumoto | 347/49 |
| 5,466,073 | 11/1995 | Rossi et al. | 400/197 |
| 5,640,181 | 6/1997 | Uchida et al. | 347/30 |

FOREIGN PATENT DOCUMENTS

| | | |
|---|---|---|
| 0 515 127 A2 | 11/1992 | European Pat. Off. . |
| 0 590 669 A1 | 4/1994 | European Pat. Off. . |
| 2 341 441 | 9/1977 | France . |
| 570 267 | 12/1975 | Switzerland . |
| 2 035 213 | 6/1980 | United Kingdom . |

*Primary Examiner*—Stuart N. Hecker
*Attorney, Agent, or Firm*—Sughrue, Mion, Zinn, Macpeak & Seas, PLLC

[57] ABSTRACT

The feed system is constituted by an ink reservoir and a peristaltic pump. The reservoir has a wall defining a chamber for containing ink and a flexible hose communicating between the inside and the outside of the chamber. The flexible hose has a portion of its length placed outside the chamber against the wall, serving as the suction duct for the peristaltic pump, and constituting a product that is discardable after the ink in the reservoir has been consumed.

6 Claims, 1 Drawing Sheet

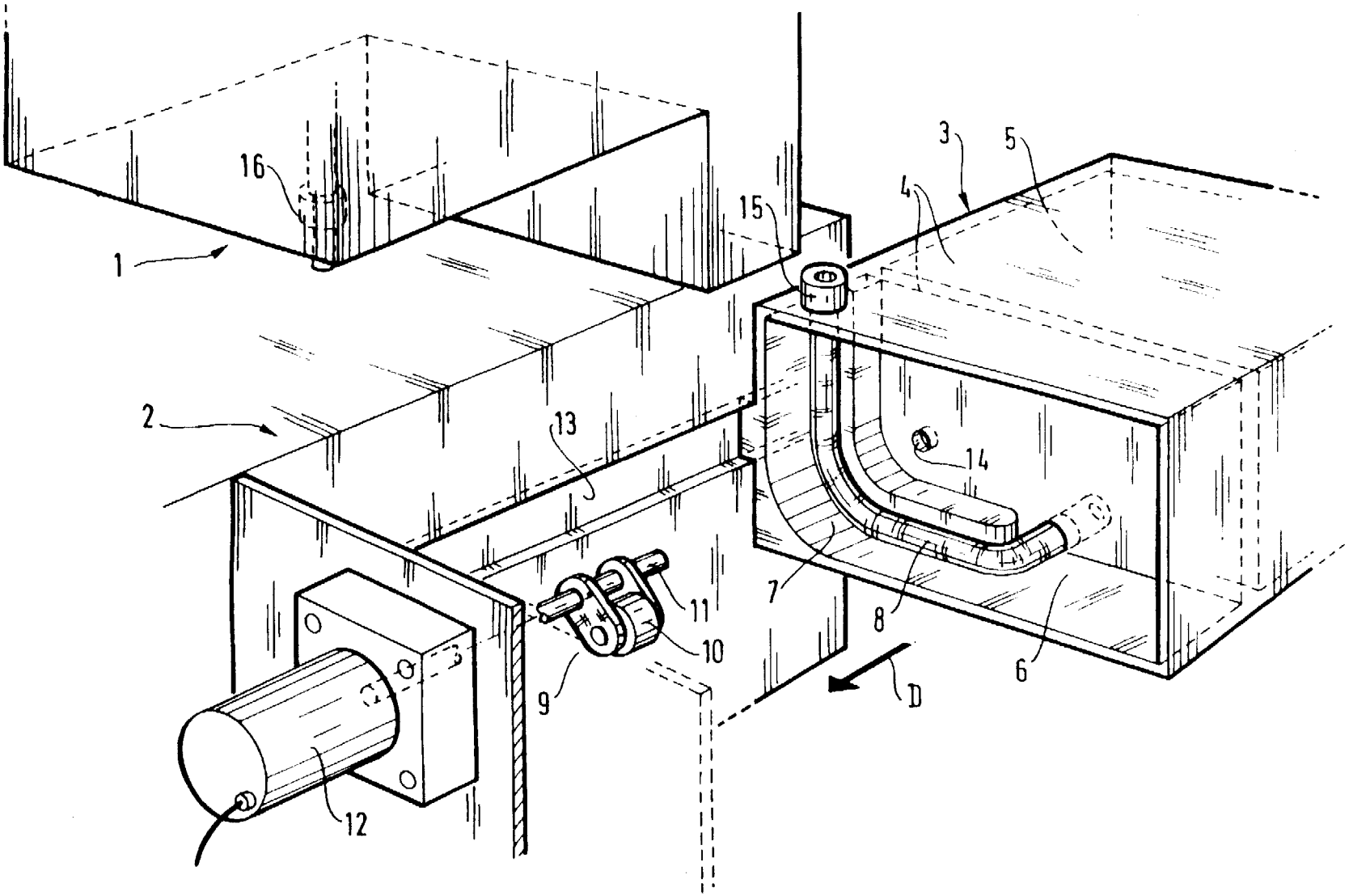
1
2
3
4
5
6
7
8
9
10
11
12
13
14
15
16
D

INK FEED SYSTEM FOR A POSTAGE METER

BACKGROUND OF THE INVENTION

The invention relates to postage meters, and more particularly to those which include a system for printing a postage imprint by ink jet means.

Such machines have an ink feed system constituted by an ink reservoir and a pump which delivers ink from the ink reservoir to the print system.

OBJECT AND SUMMARY OF THE INVENTION

The object of the invention is to improve such an ink feed system.

To this end, the invention provides an ink reservoir comprising a wall defining a chamber for containing the ink and a flexible hose communicating between the inside and the outside of the chamber, the hose having a portion of its length placed outside the chamber against the wall and serving as a suction duct for a peristaltic pump.

Thus, the invention is based on the idea of integrating all or part of a pump in an ink reservoir for feeding a print system of a postage meter, and in particular integrating the suction duct of a peristaltic pump therein, such that the reservoir and the associated pump portion constitutes a product that is discardable after the ink in the reservoir has been consumed.

Since the operating lifetime of an ink reservoir is much shorter than the lifetime of a flexible hose acting as the suction duct of a peristaltic pump, such a pump may advantageously be used in a postage meter that has an ink jet printer. The invention makes it possible to overcome the problem of reliability associated with a peristaltic pump when it is used for pumping inks that are viscous and aggressive such as those used for printing postage imprints.

In addition, a peristaltic pump is highly appropriate for an ink jet printing system, i.e. for use with nozzles, since it is a pump of the self-priming type and it enables a constant flow rate of ink to be obtained independently of the viscosity of the ink. In addition, such a pump operates silently and is very compact. It is very cheap. Finally, the invention contributes to simplifying maintenance operations on postage meters.

BRIEF DESCRIPTION OF THE DRAWING

An embodiment of the invention is described below in detail with reference to the sole figure of the accompanying drawing which is a partially exploded diagrammatic perspective view of the ink feed system of the invention.

MORE DETAILED DESCRIPTION

In the figure, the postage meter comprises an ink jet printer system referenced 1, a base referenced 2, and an ink cartridge referenced 3. A print system forming a portion of the head of the machine is mounted on the base of the machine, as is the cartridge.

According to the invention, the removable cartridge 3 that forms a reservoir has a wall 4 defining a chamber 5 for storing ink. The wall 4 also defines a setback 6 on the outside of the chamber, said setback having a surface 7 that is in the form of an arc of a circle. A flexible hose 8 communicating between the inside and the outside of the chamber 5 has a portion of its length extending along the surface 7 outside the chamber. The hose 8 serves as a suction duct for a peristaltic pump 9 mounted on the base 2. The pump has a roller 10 mounted on a shaft 11 and rotated by an electric motor 12.

When the cartridge 3 is mounted on the base 2 by engagement in the direction of arrow D (with the help of a slideway 13), the free end of the shaft 11 is received in a blind hole 14 provided in the wall 4. When the shaft 11 is rotated by the motor 12, its roller 10 compresses the hose 8 against the surface 7 so that ink is sucked from the chamber 5. It should be observed that the flexible hose 8 could equally well be formed in the wall 4 defining the circularly arcuate surface 7.

The free end of the hose is provided with a duct coupling member 15 for co-operating with another duct coupling member provided on the print system 1. The member 15 is designed to close the hose 8 whenever it is separated from the member 16 so as to prevent the ink escaping from the cartridge 3 when the cartridge is removed from or installed on the base 2. In particular, the member 15 may be provided with a shutter ball actuated by a spring, and the member 16 may be provided with a needle that pushes aside the shutter ball when the print system 1 is mounted on the base 2 and is connected to the cartridge 3.

The ink feed system of the invention requires little maintenance since the flexible hose (constituting the element that is likely to be worn out the soonest) is changed each time the cartridge 3 is replaced. Since cartridge replacement is performed by the user of the machine, the cost of maintaining the machine is reduced correspondingly.

We claim:

1. An ink reservoir for feeding a print system with ink, the reservoir comprising a wall defining a chamber for containing the ink, incorporating at least one flexible hose communicating between the inside and the outside of the chamber, the flexible hose having a portion of its length placed outside the chamber and serving as a suction duct for a peristaltic pump, and constituting a product that is discardable after the ink in the reservoir has been consumed.

2. A reservoir according to claim 1, in which said wall defines a setback having a surface in the form of a circular arc and along which said portion of the length of the flexible hose extends.

3. A reservoir according to claim 1, in which the flexible hose is provided at its free end with a duct coupling member designed to co-operate with another duct coupling member, and designed to close the hose whenever it is separate from said other coupling member.

4. A reservoir according to claim 1, in which the said portion of the length of the flexible hose is formed in the wall of the reservoir.

5. A postage meter comprising an ink jet print system, an ink reservoir according to claim 1, and a peristaltic pump for moving ink from the reservoir towards the print system.

6. A postage meter according to claim 5, in which the ink reservoir fitted with the flexible hose is mounted in removable manner in the meter so as to constitute a product that can be discarded after use.

* * * * *